United States Patent [19]

Akashi

[11] Patent Number: 4,610,057

[45] Date of Patent: Sep. 9, 1986

[54] SEPARABLE SLIDE FASTENER

[75] Inventor: Shunji Akashi, Kurobe, Japan

[73] Assignee: Yoshida Kogyo K.K., Tokyo, Japan

[21] Appl. No.: 680,848

[22] Filed: Dec. 12, 1984

[30] Foreign Application Priority Data

Dec. 13, 1983 [JP] Japan ..... 58-191771[U]

[51] Int. Cl.[4] ..... A44B 19/00

[52] U.S. Cl. ..... 24/433; 24/418

[58] Field of Search ..... 24/433, 434, 420, 418, 24/424

[56] References Cited

U.S. PATENT DOCUMENTS

| | | | |
|---|---|---|---|
| 2,649,638 | 8/1953 | Morin | 24/433 X |
| 4,244,087 | 1/1981 | Akashi | 24/433 |
| 4,377,022 | 3/1983 | Akashi | 24/433 X |
| 4,459,723 | 7/1984 | Takano | 24/433 X |

FOREIGN PATENT DOCUMENTS

| | | | |
|---|---|---|---|
| 891665 | 3/1962 | United Kingdom | 24/433 |
| 2099499 | 12/1982 | United Kingdom | 24/433 |

*Primary Examiner*—Peter A. Aschenbrenner

*Attorney, Agent, or Firm*—Hill, Van Santen, Steadman & Simpson

[57] ABSTRACT

A separable slide fastener comprises a pair of stringers, a slider and a separable bottom end assembly. Such bottom end assembly includes a socket connected to one of the paired stringers, a first pin projecting from the socket and secured to that stringer, and a second similar pin connected to the other stringer and having a planar outer surface. The first pin has a first outer flat surface disposed adjacent to and flush with the second pin, and a second outer surface extending from the first flat surface and beveled toward the plane of the associated stringer.

3 Claims, 6 Drawing Figures

SEPARABLE SLIDE FASTENER

BACKGROUND OF THE INVENTION

1. Field of the Invention

This invention relates to slide fasteners and more specifically to an improved slide fastener having a separable bottom end assembly. Such fastener is particularly suitable for use with self-locking sliders.

2. Description of the Prior Art

Numerous slide fasteners of the separating type have been proposed, a typical example of which is provided with a pin-and-socket connector commonly referred to as a separable bottom end assembly and mounted on a pair of fastener stringers at their lower ends. This connector is composed of a socket member clamped to one of the stringers, a socket pin extending from the socket and secured to that stringer, and a guide pin clamped to the other stringer. The guide pin is releasably insertable into the socket.

A self-locking slider is slidably mounted on the opposed longitudinal edges of the stringers. The slider includes a slider body, a pull tab pivotally connected thereto, and a locking prong operatively associated with the pull tab. The locking prong is engageable with the leg portion of any one coupling element on the socket-carrying stringer when the pull tab is in locked position. As the slider is lowered to contact with the socket, the locking prong comes to ride directly above the socket pin.

A transverse pull exerted above the slider permits the guide pin to be extracted or withdrawn first from the socket and then from the slider after full disengagement of the coupling elements by the slider, i.e. with the slider located immediately adjacent to the socket. Thus, the fastener halves are completely separated from each other.

However, this conventional separable slide fastener is objectionable in that the guide pin fails oftentimes to move into the slider when interconnecting the fastener halves that have been separated. This has been found attributable to the fact that the socket pin has a rod-like shape and is planar throughout its outer surface.

Such a socket pin on one stringer generally assists in withdrawing or thrusting a guide pin on the other stringer out of or into a slider when opposed fastener halves are separated or coupled together.

In the known separable fastener structure, removal of the guide pin fully from the slider causes the latter to tilt or deflect angularly with respect to the socket-carrying stringer and the locking prong displaced outwardly of the socket pin. Under this condition, when an attempt is made to insert or thread the guide pin into the slider, the locking prong bears against and is caught by the socket pin on the outer side wall thereof directed to the associated stringer. The guide pin when thus threaded into the slider abuts at its tip end against the corner of the socket pin and hence cannot be reassembled with the slider.

Therefore, the prior art technique has always required the locking prong to be moved or retracted out of contact with the side wall of the socket pin by manipulating the pull tab in such a manner that the slider held in deflection may take its proper or upright posture. This is tedious and unsatisfactory for practical use.

SUMMARY OF THE INVENTION

A separable slide fastener is provided which comprises a pair of oppositely disposed stringers each carrying a row of coupling elements along one longitudinal edge portion thereof. A slider is movable reciprocably on and along the pair of stringers to couple and uncouple the coupling elements, the slider including a locking prong. A separable bottom end assembly is mounted on adjacent lower ends of the stringers and includes a socket member, a first separate pin member and a second separate pin member. The socket member is fixedly connected to one of the stringers. The first pin member projects from the socket member and is fixedly connected to that one stringer. The second pin member is fixedly connected to the other stringer and extends at both of its ends beyond the ends of the first pin member, the second pin member having a substantially planar outer surface. The first pin member has a first outer surface defined flatly adjacent to and flush with the second pin member, and a second outer surface extending integrally from the first flat surface and beveled toward the plane of its associated stringer.

It is one object of this invention to provide an improved slide fastener of the separable type which is free of the above noted difficulties of the prior art and which is efficient and effective in use and simple in construction.

Another object of the invention is to provide such an improved fastener which assures smooth, reliable interconnection of two opposed stringers once separated, even when a slider is in tilted posture with respect to the plane of the fastener, by means of a special bottom end assembly.

Many other advantages, features and additional objects of this invention will become better understood by reference to the following detailed description when considered in connection with the accompanying drawings.

DETAILED DESCRIPTION

Figure 1:
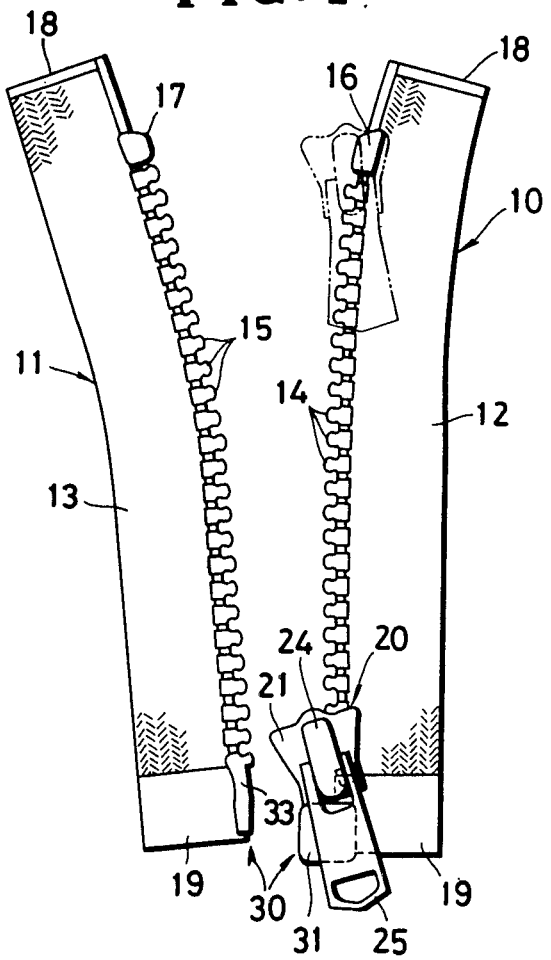
FIG. 1 is a plan view of a separable slide fastener embodying this invention.

With reference to the drawings and more particularly to FIG. 1, there is shown a slide fastener of the separable type which embodies this invention. The fastener comprises a pair of stringers 10 and 11, a slider 20 and a separable bottom end assembly 30. The stringers 10, 11 include carrier tapes 12 and 13 each having a row of spaced-apart coupling elements 14 or 15 formed from suitable thermoplastic material and attached to one longitudinal edge thereof. The slider 20, hereinafter described, is disposed to reciprocably move on and along the coupling elements 14 and 15 whereby the fastener is opened and closed. Mounted on the confronting lower end portions of the stringers 10 and 11 is the bottom end assembly 30, details of which are described hereinafter.

Secured adjacent to the uppermost coupling elements on the carrier tapes 12 and 13 are top end stops 16 and 17 for limiting the movement of the slider 20 in the closed direction. The carrier tapes 12 and 13 are also provided at their respective upper end portions with reinforcing strips 18 and 18 adapted to prevent the tape ends against fraying or any tendency to tear. For the same purpose, similar but somewhat wider reinforcing strips 19 and 19 are arranged on the lower end portions of the carrier tapes 12 and 13.

Figure 2:
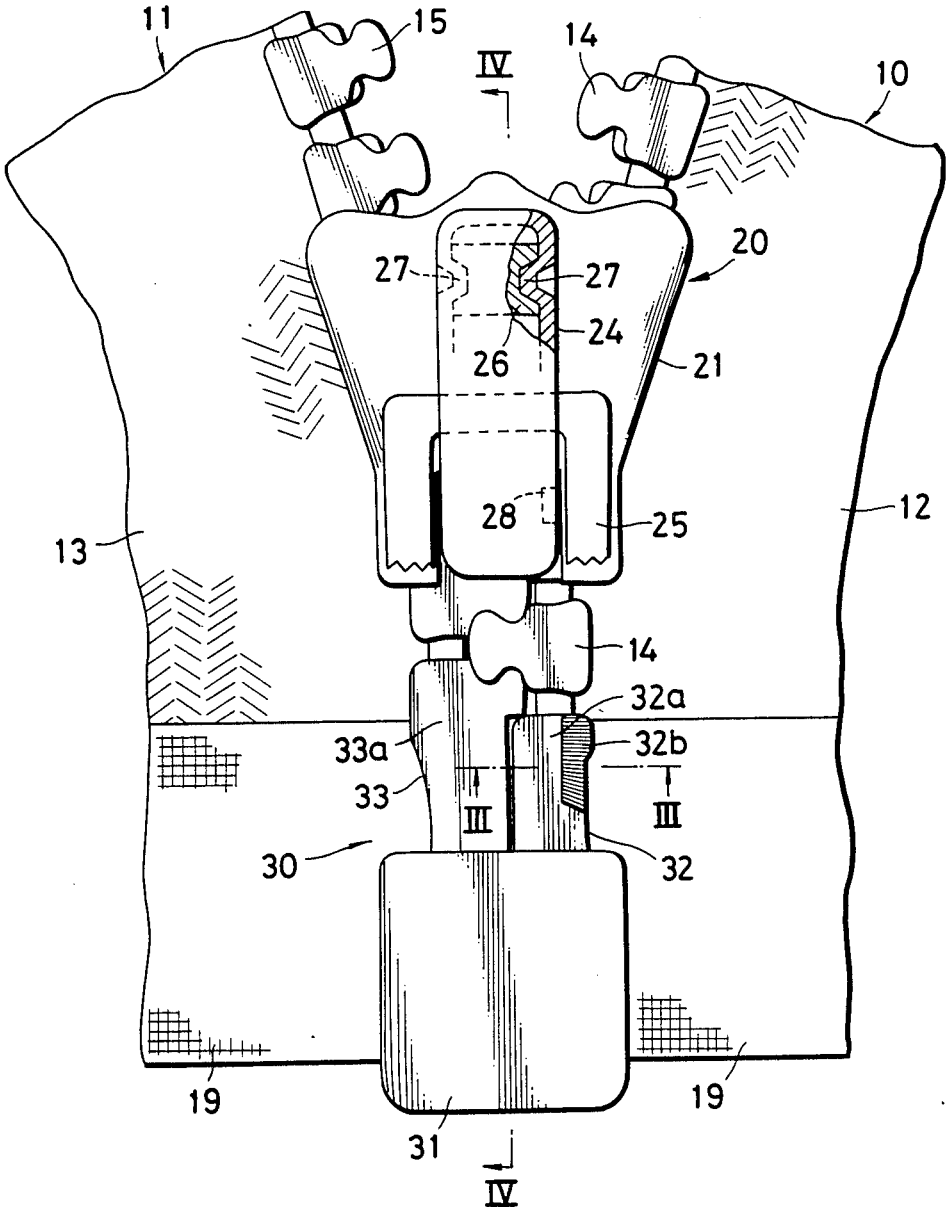
FIG. 2 is an enlarged plan view, partly broken away, of the rearward segment of the fastener of FIG. 1.

The slider 20 may be of any self-locking type well known in the art. The illustrated slider construction includes a front wing 21 and a back wing 22 (FIG. 4) united together in spaced parallel relation by a wedge 23 so as to define a substantially Y-shaped channel adapted to slidably receive the coupling elements 14 and 15. The front wing 21 has a linearly canting or sloping surface as viewed in cross-section in FIG. 4. A cover member 24 is mounted on a lug 26 integral with the front wing 21 at the foreward end thereof. The lug 26 is provided with two fulcrum ends 27 and 27, FIG. 2, which support the cover 24 for swinging movement.

To the cover 24 is pivotally secured a pull tab 25 which is a flat metal plate bifurcated at one end to define arms. A connector bar connects the arms and engages with the cover 24 through a pair of openings 24*a* in the side walls thereof. A locking prong 28 is arranged integrally with the rear end of the cover 24 and positioned to project into and out of the slider channel for passage of the coupling elements 14 on one of the two stringers 10 and 11, i.e. the right stringer 10. A leaf spring 29 is cantilever-mounted on the front wing 21 over its canted surface and cooperates with both the pull tab 25 and the locking prong 28. A pair of angular ears 29*a* are fixedly mounted on the lateral edges of the leaf spring 29 and adapted to restrain movement of the pull tab 25 within the cover 24.

Because of the resilience imparted by the leaf spring 29, the locking prong 28 is normally urged against any one selected coupling element 14 on the right stringer 10 when the pull tab 25 is in locked position. The slider 20 is thus held immovable. Forcibly downward movement of the pull tab 25 permits the cover 24 to turn counter-clockwise about the fulcrum ends 27 and 27 in the position shown in FIG. 4. In response to the turning of the cover 24, the locking prong 28 is lifted away from the coupling element 14, rendering the slider 20 freely movable.

The bottom end assembly 30 comprises a socket member 31 fabricated from thermoplastic material and fixedly connected to the reinforced lower end portion of the right stringer 10 from which an elongate socket pin member 32 projects and is attached to the stringer 10. A similar guide pin member 33 is fixedly connected to the reinforced lower end portion of the left stringer 11. The guide pin 33 is somewhat longer and extends at both of its ends beyond the ends of the socket pin 32. The socket 31 has an inner cavity adapted to removably accommodate the guide pin 33. The guide pin 33 is formed with a rectangular bar of thermoplastic material and has a substantially planar outer surface 33*a* parallel to the plane of each of the stringers 10 and 11.

Figure 3:
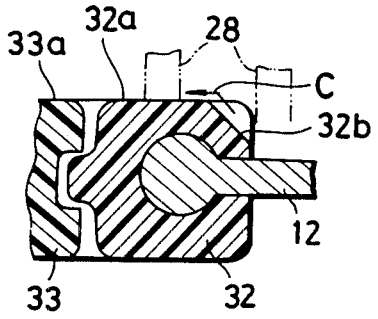
FIG. 3 is a cross-sectional view taken along the line III—III of FIG. 2.

An important feature of this invention resides in the configuration of the socket pin 32. Like the guide pin 33, the socket pin 32 is made up of a rectangular bar of thermoplastic material, but has two different outer surfaces 32*a* and 32*b*. As shown in FIG. 3, one surface 32*a* is substantially straight or flat and is flush with the guide pin 33, while the other surface 32*b* extends integrally from the flat surface 32*a* and is beveled toward the plane of the stringer 10. The beveled surface 32*b* is so dimensioned as to be close to the stringer 10 and apart from a certain region on the socket pin 32. This region is one bounded and occupied by the locking prong 28, FIG. 5, when the slider 20 is brought into upright contact with the socket 31. Moreover, the beveled surface 32*b* on the socket pin 32 terminates short of the foreward end of the socket 31.

Figure 4:
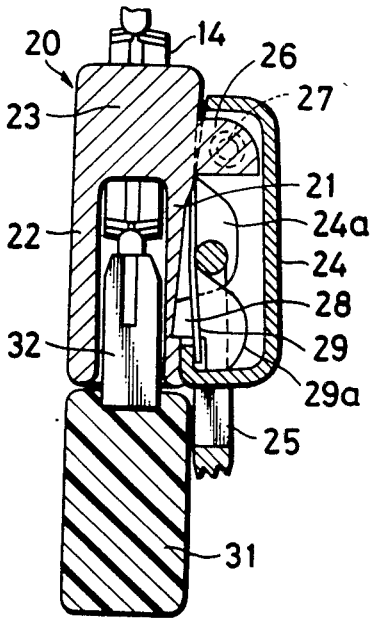
FIG. 4 is a cross-sectional view taken along the line IV—IV of FIG. 2 and showing a pull tab being put into unlocked position.

With the above-described arrangements, the locking prong 28 remains rested directly above the flat surface 32*a* on the socket pin 32, as viewed in FIG. 4, when the guide pin 33 is in threaded engagement with both the slider 20 and the socket 31. In this position, the slider 20 is maintained in proper or stable posture. Upon withdrawal of the guide pin 33 first from the socket 31 and then from the slider 20, the slider 20 moves to be tilted with respect to the plane of the stringer 10, as shown by the slider longitudinal axis or line A in FIG. 5. Such slider movement thus displaces the locking prong 28 outwardly upwardly of the beveled surface 32*b*.

Figure 5:
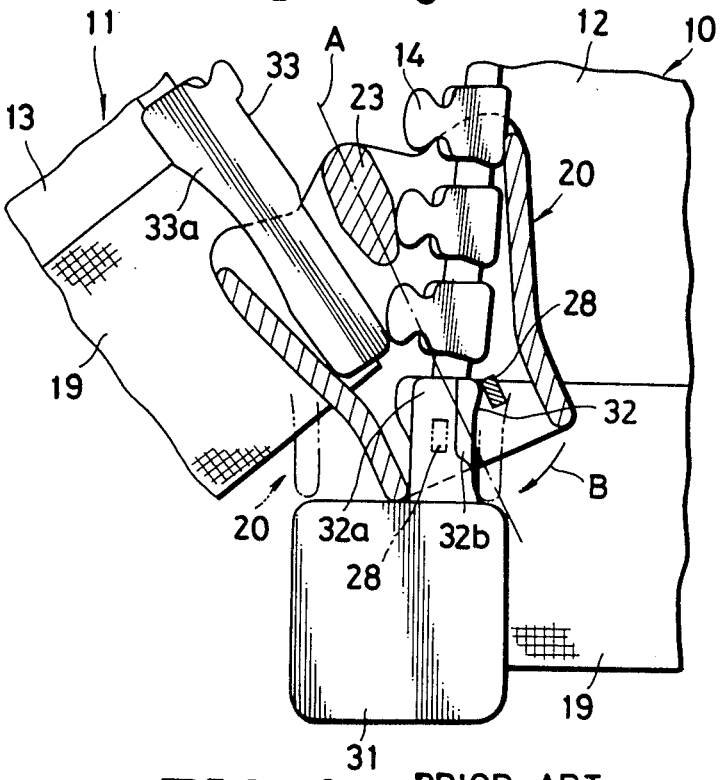
FIG. 5 is a fragmentary plan view showing the manner in which a guide pin is being inserted into a slider.

In the position shown in FIG. 5, as the guide pin 33 is threaded into the slider 20, the latter turns in a clockwise direction, indicated by the arrow B, and allows the locking prong 28 to smoothly travel on the beveled surface 32*b* and then ride over the flat surface 32*a*. Accordingly, the slider 20 can be put into its proper posture, with the guide pin 33 fitly interengaged therewith. It should be noted that this particular advantage accrues from the cam-like action of the beveled surface 32*b*, as will be best seen from the arrow C in FIG. 3, with respect to the movement of the locking prong 28.

Figure 6:
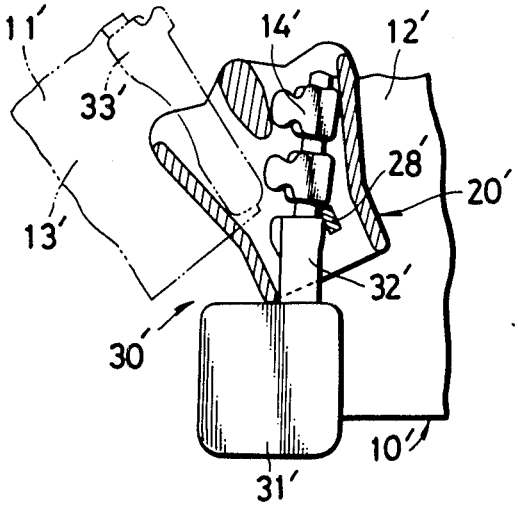
FIG. 6 PRIOR ART
FIG. 6 is a view similar to FIG. 5, but showing a prior art bottom end assembly.

FIG. 6 shows a prior art arrangement in which like primed reference numerals designate like parts already described in connection with FIGS. 1 to 5 and which shows the manner in which a guide pin 33' is being threaded into a slider 20' tilted angularly in the plane of the fastener. Effective threading is difficult to achieve between the guide pin 33' and the slider 20' in this known arrangement. The guide pin 33' is prone to bear against the corner of a socket pin 32', with a locking prong 28' caught by the outer side wall of the socket pin 32'.

While there has been shown and described what is considered to be a preferred embodiment of this invention for purposes of illustration only, it will be apparent to those versed in the art that various changes and modifications may be made thereto without departing from the spirit or scope of the invention as set forth in the appended claims.

What is claimed is:

1. A separable slide fastener comprising:

(a) a pair of oppositely disposed stringers each carrying a row of coupling elements along one longitudinal edge portion thereof;

(b) a slider movable reciprocably on and along said pair of stringers to couple and uncouple the coupling elements, said slider including a substantially Y-shaped guide channel for the passage of said rows of coupling elements and a locking prong movable into and out of said guide channel for releasably locking said slider on said rows of coupling elements; and (c) a separable bottom end assembly mounted on adjacent lower ends of said stringers and including;

(1) a socket member fixedly connected to one of said stringers;

(2) a first separate pin member projecting from said socket member and fixedly connected to said one stringer, said first separate pin member being receivable in said guide channel of said slider;

(3) a second separate pin member fixedly connected to the other of said stringers in opposite relation to said socket member and said first separate pin member and receivable in said guide channel and said socket member, said second pin member having a substantially planar outer surface extending substantially parallel to the general plane of said slide fastener; and (4) said first pin member having a first outer flat surface disposed adjacent to said second pin member and extending substantially flush with said planar outer surface of said second pin member, and a second outer beveled cam surface contiguous to said first flat outer surface and extending away from said second pin member downwardly toward the plane of said one stringer, said second outer beveled cam surface being engageable with said locking prong to cause the latter to move upwardly along said beveled cam surface into engagement with said first outer flat surface, in response to threading movement of said second pin member into said guide channel of said slider and said socket member while said slider is at rest on said socket member.

2. A separable slide fastener according to claim 1, said second outer beveled cam surface extending from a distal end of said first pin member toward said socket member and terminating short of said socket member.

3. A separable slide member according to claim 1, said sider having a spring biasing said locking prong toward one of said rows of coupling elements.

* * * * *